United States Patent [19]

Toelke et al.

[11] 4,257,245

[45] Mar. 24, 1981

[54] COMPRESSION SHOCK ABSORBER DEVICE

[75] Inventors: Lester Toelke; J. D. Kimmel, both of Houston, Tex.

[73] Assignee: Well Control, Inc., Houston, Tex.

[21] Appl. No.: 74,836

[22] Filed: Sep. 13, 1979

[51] Int. Cl.[3] ..... E12B 17/07

[52] U.S. Cl. ..... 64/23; 175/321

[58] Field of Search ..... 64/23, 23.5, 23.7; 175/299, 321; 277/17, 59, 62; 68/23.1; 248/562, 564, 570; 267/136

[56] References Cited

U.S. PATENT DOCUMENTS

| | | | |
|---|---|---|---|
| 3,383,126 | 5/1968 | Salvatori | 175/321 |
| 3,447,652 | 6/1969 | Tipton | 175/321 |
| 3,735,828 | 5/1973 | Berryman | 175/321 |
| 3,949,150 | 4/1967 | Mason | 64/23 |
| 4,086,788 | 5/1978 | Garrison | 64/23 |

*Primary Examiner*—Samuel Scott
*Assistant Examiner*—G. Anderson
*Attorney, Agent, or Firm*—Arthur A. March

[57] ABSTRACT

Well bore drill string shock absorber device for absorbing drill bit vibratory displacement shock, contemplating a pair of slidably, e.g. telescopingly, associated longitudinal elements, one of which is connectable to a drill string therabove and the other of which is connectable to a drill bit therebelow, such elements being interengageably interconnected for common rotation about a longitudinal, e.g. well bore, axis and for selectively limited relative reciprocal displacement longitudinally with respect to each other along such axis, and such elements together defining a shock absorber work chamber within longitudinal confinement wall portions thereof, e.g. an annular cylindrical chamber, of varying selective maximum and minimum operative longitudinal dimension and corresponding volume in dependence upon such displacement of the elements and in turn of such wall portions, and temporarily internally compressible and resilient shock absorbing means, e.g. an elastomeric material such as silicone rubber, of self-sustaining selective three dimensional perimetric shape, disposed between such confinement wall portions in lateral abutting contact with at least a portion of the longitudinal extent of at least one of such wall portions, and preferably having a normal volume confined within and occupying substantially completely the interior of the work chamber at maximum longitudinal dimension and corresponding volume, and operatively arranged with respect to such elements so as to be placed under dynamic longitudinal stress corresponding to vibratory drill bit displacement shock upon such displacement of the elements, and being capable of supportively absorbing strain in internal direction and within the confines of its three dimensional perimetric shape to reduce its normal volume and concordantly increase its density without expansion or deformation in external direction outside the confines of its said shape when placed under pressure, i.e. load, and of returning to its original volume when such pressure is released.

34 Claims, 7 Drawing Figures

COMPRESSION SHOCK ABSORBER DEVICE

Figure 1A:
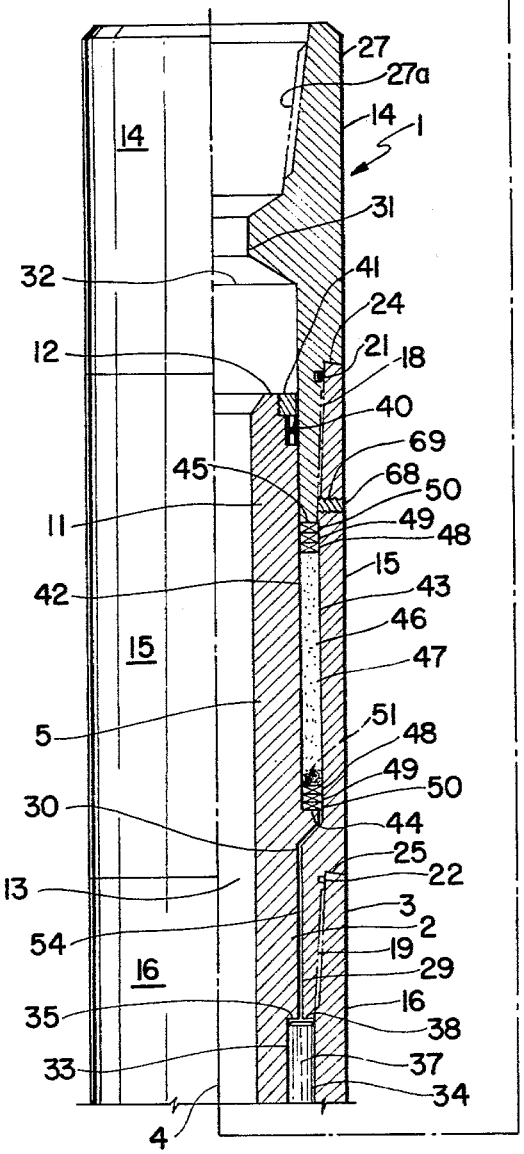

The present invention relates to a drill bit shock absorber device for use in well bore drilling, and more particularly to such a device utilizing compression shock absorbing means which is temporarily internally compressible and resilient, and which is capable of supportively absorbing strain in internal direction and essentially solely within the confines of its three dimensional perimetric shape.

Drill bit shock absorber devices or shock subs are known types of devices which are provided in a drill string above the drill bit during well bore drilling to take up the often violent, hard and unevenly generated and distributed vibratory displacement shock which occurs at the down hole end of the bore. During rough drilling, such vibratory displacement shock causes excessive wear and tear to down hole tools such as the drill bit drill collars, drill pipe, various intermediate joints, bearings, thread connections, etc. as well as to surface rig equipment, especially in the case of relatively shallow holes, such as the rotary table, bushings, kelly, swivel, drilling line, derrick, draw works, etc.

The nature and characteristics of such vibratory shock vary with many factors such as the degree of comparative hardness of the underground formation or stratum being drilled, the depth of the hole and the resultant weight or mechanical pressure of the components of the drill string above the drill bit which is cumulatively exerted downwardly thereagainst, as well as the extent to which ambient down hole hydrostatic pressure may be exerted in counter direction upwardly thereaginst. Also, where a drilling fluid supply is continuously provided to aid in the drilling process, the extent to which the dynamic hydraulic pressure of the flow thereof may act downwardly on the drill string components and in turn against the drill bit is an added factor, e.g. insofar as it may counteract the vibratory shock and/or the effect of the force of the ambient hydrostatic pressure as is sometimes desirable.

These factors and the consonant problems connected therewith are all well known. Various devices have been provided to absorb under compression or deformation such drill bit vibratory shock, either by reason of mechanical means, particular non-mechanical shock absorbing material, or both, while avoiding to some extent the adverse influence of such often competing factors on well bore drilling.

In this regard, U.S. Pat. No. 3,128,102 to Beck concerns a drilling device in the form of a telescopingly slidably associated housing and mandrel provided with an annular seal assembly therebetween constituted as an intermediate mechanical compression coil spring arranged to exert pressure axially outwardly against an opposed pair of sealing units, each composed of a composite of a beveled annular rubber seal bounded between oppositely beveled annular lead seals so as to deform the rubber seals of the two units radially outwardly, i.e. out of their normal shape, into sealing engagement with the surrounding axially extending wall portions thereat, with the space between the sealing units optionally preloaded with grease or other fluid. The complex device is intended to act as a shock absorber against axially directed force, utilizing the annular seal assembly and in particular the mechanical coil spring for this purpose. However, the beveled rubber seals serving as primary sealing elements are inherently subject to accelerated wear and tear, and especially to accelerated degradation, under the high ambient pressures and formation temperatures encountered in the down hole end of the well bore during drilling operations.

U.S. Pat. No. 3,323,327 to Leathers et al utilizes a telescopingly partially slidably associated tubular housing and tubular mandrel as a shock absorber device for drilling operations in which axial displacement is taken up by an intermediate radially deformable plastic hollow cylindrical compression type component interposed as an isolating member structurally along the mandrel and connected in tandem to the other mandrel components. Drilling fluid supply flows centrally through the plastic hollow cylindrical component in direct contact therewith. Such plastic component may be composed of Delrin acetal resin, a trade name of Dupont Chemical Company for polymerized formaldehyde, and is radially spaced from the adjacent surrounding inner wall of the housing essentially to allow for sufficient radial deformation when subjected to axially directed squeezing force so that it can perform its shock absorbing role. A bilateral annular floater seal is provided, which is in flow-communication on one side thereof with a fluid filled chamber between the inner mandrel and outer housing and along the adjacent exterior wall of the deformable plastic cylinder component, and which is in flow-communication on the opposite side thereof with the ambient operating fluid pressure, whereby to provide a balanced low pressure sealing arrangement between the mandrel and housing. To serve the stated purposes, however, the plastic shock absorbing component inherently must be structurally and/or mechanically rigid or hard, i.e. sufficiently to support fixedly the remainder of the mandrel components suspended therebelow and withstand the abrasive action of the drilling fluid supply washing downwardly therethrough.

U.S. Pat. No. 3,406,537 to Falkner, Jr. shows another complex shock absorber device for use in drilling operations, also involving a telescopingly slidably associated housing and mandrel. The device is provided with radially deformable stainless steel woven mesh annular spring-like mechanical cushion or compression members arranged in a sealed bath of non-compressible oil for absorbing axially directed force, coupled with a similar bilateral annular floater seal in flow-communication therewith on one side of such floater seal both to pressure balance the bath and spring-like members with the ambient drilling fluid supply flow pressure exerted against the opposite side of the bilateral floater seal from within a central supply bore in the mandrel, and to compensate as well for thermal expansion of the oil in the sealed bath during use.

U.S. Pat. No. 3,949,150 to Mason et al provides a drill bit shock absorbing tool also composed of a telescopingly slidably associated housing and mandrel in which a single long annular radially deformable, yet non-compressible, urethane plastic body, or a long stack of individual annular radially deformable, yet non-compressible, urethane plastic washers interconnected with alternating respective annular metal washers, is used as shock absorbing means for absorbing axially directed force between the mandrel and housing. The radially deformable, non-compressible plastic body or stack of washers is radially spaced from the adjacent axially extending walls of the mandrel and housing to prevent frictional contact therewith and resultant destruction of the plastic material, and is sealed in a bath of non-compressible oil in pressure flow-communication with one side of a bilateral annular floater seal, the other side of which is in balancing pressure flow-communication with the ambient operating fluid, It is also generally known to use oil in dash pot or restricted flow escape type chambers for absorbing axially exerted forces between the mandrel and housing, or to provide a body of special silicone base compressible fluid under preloaded pressure in a sealed chamber as shock absorbing means between such parts.

However, none of these various known arrangements provide for sustained high temperature shock absorbing performance at ambient formation temperatures under mechanical, pneumatic, hydrostatic and/or hydraulic service pressures as may be normally encountered during down hole bottom end drilling operations in well bores, for long lasting use without accelerated wear and tear, and temperature degradation or destruction of the shock absorbing means including at least in part non-metallic solid shock absorbing materials, and without undue need for special precautions, e.g. as to extra spacing and clearance, to accommodate lateral or radial deformation and avoid friction and wear of the particular non-metallic solid plastic shock absorbing material used within the laterally or radially confined annular space between the relatively axially displaceable mandrel and housing constituting the functioning parts of the device.

It is among the objects and advantages of the present invention to overcome the various drawbacks of prior art constructions and arrangements, and to provide a unique combination of associated long-lasting parts and elements constituting an efficient, durable, inexpensive and simple well bore drill string shock absorber device for absorbing drill bit vibratory displacement shock, throughout a wide range of sustained ambient formation temperatures and mechanical, pneumatic, hydrostatic and/or hydraulic operating pressures as may be encountered during down hole bottom end drilling in a well bore, on-shore or off-shore.

It is among the further objects and advantages of the present invention to provide a shock absorber device of the foregoing type which may be readily used without special precautions or constructional provisions as to extra spacing and clearance to accommodate lateral or radial deformation and avoid friction and wear of the particular shock absorbing material used between the relatively longitudinally or axially displaceable associated elements constituting the functioning parts of the device, and employing at least in part as shock absorbing means a temporarily internally compressible, i.e. compressible within itself, and resilient non-metallic material, e.g. an elastomeric material such as silicone rubber, of substantially self-sustaining selective three dimensional perimetric shape, and which is capable of supportively absorbing strain in internal direction and, more or less essentially solely, within the confines of its said shape to reduce its normal volume, and concordantly increase its density, substantially without expansion, e.g. lateral bulging, or deformation, e.g. extruding, in external direction outside such three dimensional perimetric confines when placed under pressure, i.e. longitudinally or axially exerted load, and of returning to its original volume when such pressure is released.

It is among the still further objects and advantages of the present invention to provide such a shock absorber device wherein the shock absorbing means at least in part is in the form of preferably, pliable, as distinguished from rigid or hard, externally non-flowable or non-extrudable, firm, preformed solid means of structural integrity and mechanical stability, and preferably which is capable of resisting sustained temperatures up to at least about 400° F. without significant functional degradation in internal compressibility, resiliency and self-sustaining three dimensional perimetric shape.

It is among the still further objects and advantages of the present invention to provide such a shock absorber device wherein the shock absorbing means is capable when completely confined and placed under dynamic longitudinal stress of reducing its composite volume in excess of about 2.6% at a stress load of 5000 psi and up to about 11.5% at a stress load of 20,000 psi, and correspondingly of returning to its original composite volume when the stress load is released, and preferably wherein the shock absorbing means, e.g. a silicone rubber material, is maintained in a work chamber in a bath of a compressible liquid, e.g. a silicone oil, having a more or less substantially equivalent or concordant volume reduction thereto under dynamic stress, for attendant heat conduction, lubrication and filling of any void spaces within the confines of the work chamber.

It is among the still further objects and advantages of the present invention to provide a device of the foregoing type wherein the shock absorbing means is normally maintained in substantially constant lateral or radial, preferably tight, abutting contact and inter-supportive engagement with at least a longitudinal part of at least one, and preferably both, of the adjacent wall portions of the relatively longitudinally or axially displaceable associated elements constituting the functioning parts of the device for transferring heat thereto, for contributing to the radial supportive interconnection of the longitudinally reciprocating parts, and for enhancing the sealing relation between such parts.

Figure 1B:
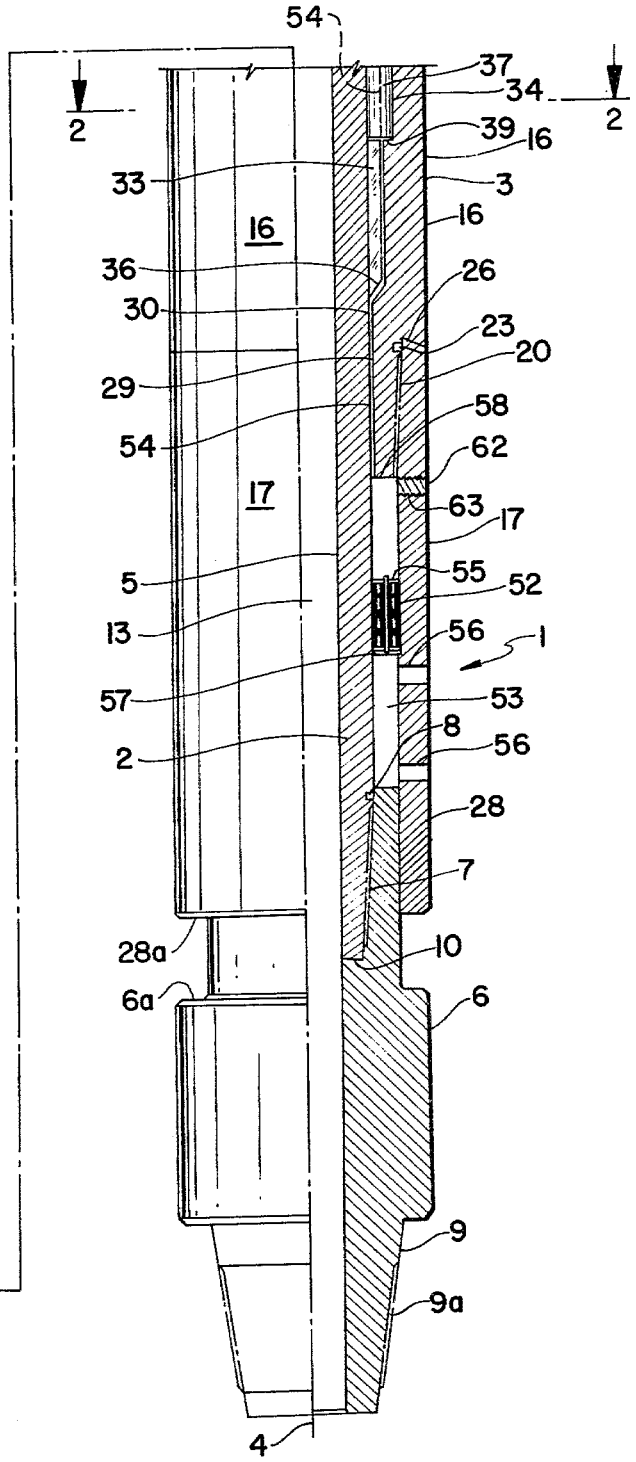
Figure 2:
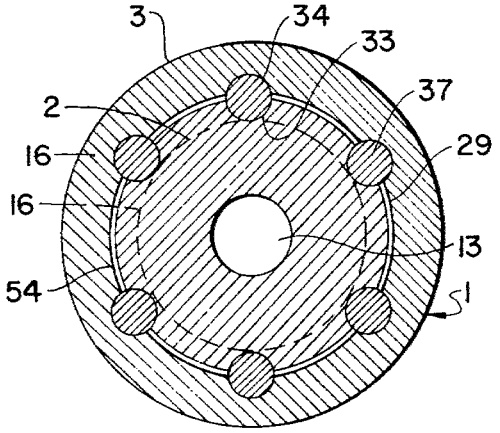
Figure 3:
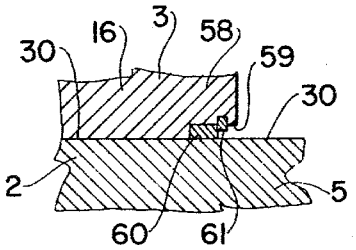
Figure 4:
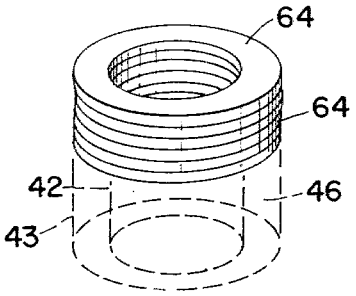
Figure 5:
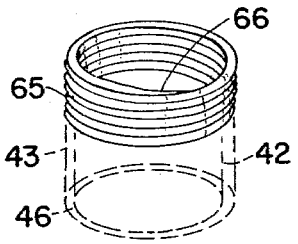
Figure 6:
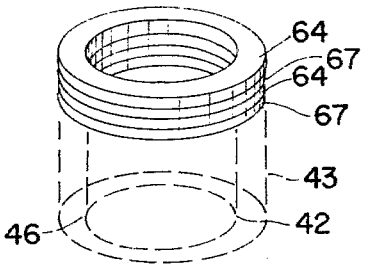

Other and further objects and advantages of the invention will become apparent from a study of the within specification and accompanying drawings, in which:

FIGS. 1*a* and 1*b* are schematic partial sectional view of tandem portions together constituting an embodiment of a drill string shock absorber device according to the present invention, FIG. 2 is a schematic sectional view taking along the line 2—2 of FIG. 1*b*, FIG. 3 is a schematic sectional enlarged partial view of a modified portion of the device shown in FIG. 1*b*, FIG. 4 is a schematic perspective partial view of a modified form of the shock absorbing means, arranged as a stack of individual annular washers and shown in relation to the adjacent wall portions of the device but only in part, FIG. 5 is a schematic perspective partial view of a further modified form of the shock absorbing means, arranged as a helically extending rope and shown in relation to the adjacent wall portions of the device but only in part, and FIG. 6 is a schematic perspective view of another modified form of the shock absorbing means, arranged as a stack of alternately interleaved individual annular washers and metal spacers and shown in relation to the adjacent wall portions of the device but only in part.

Broadly, the present invention concerns a drill bit shock absorber device for use in well bore drilling, in which the shock absorbing means which is subject to pressure, i.e. load, operatively between the relatively longitudinally or axially displaceable associated elements constituting the functioning parts of the device, contains at least in part material which is temporarily internally compressible and resilient and which is maintained in operative abutting contact with at least a portion of the longitudinal extent of the device.

Advantageously, such shock absorbing means is generally capable of supportively absorbing strain in internal direction and, essentially solely, within the confines of its normal or original three dimensional perimetric shape, and thus may be provided with a substantially self-sustaining selective three dimensional perimetric shape to accommodate its operative disposition within the shock absorber device for maximum efficiency.

In accordance with a primary feature of the present invention, a shock absorber device is provided for use in well bore drilling to absorb drill bit vibratory displacement shock or load, which comprises a pair of slidably associated longitudinal elements having cooperating longitudinal coacting portions and cooperating longitudinal confinement wall portions, with one of such elements being operatively connectable for instance to a component of a drill string and the other of such elements being operatively connectable for instance to a drill bit. Such elements are interengageably interconnected along their coacting portions for common rotation about a longitudinal axis and for selectively limited relative reciprocal displacement longitudinally with respect to each other along such axis. The shock absorbing means is disposed between the confinement wall portions in lateral or transverse abutting contact with at least a portion of the longitudinal extent of at least one of such wall portions and operatively arranged with respect to such elements so as to be placed under dynamic longitudinal stress corresponding to vibratory drill bit displacement shock upon such relative reciprocal displacement of the elements.

Preferably, the elements at the confinement wall portions include corresponding longitudinally opposed stress exerting means or the like providing a work space therebetween of longitudinally varying selective maximum and minimum operative longitudinal dimension in dependence upon such displacement of the elements and their wall portions, and the shock absorbing means is operatively arranged between such stress exerting means in such work space so as to be placed under such dynamic longitudinal stress thereby. More particularly, the associated elements, e.g. an inner mandrel and a tubular outer housing, together suitably define a shock absorber chamber within the confinement wall portions having such longitudinally varying selective maximum and minimum longitudinal dimension and corresponding volume.

The temporarily internally compressible and resilient shock absorbing means of substantially self-sustaining selective three dimensional perimetric shape, employed at least in composite part according to the invention, is preferably a non-metallic material confined within and having a normal volume operatively occupying substantially completely the longitudinal extent of the interior of the work chamber at maximum longitudinal dimension and corresponding volume in substantially constant bilateral inter-supportive abutting contact with at least a portion of the common longitudinal extent of both of such wall portions, and is operatively arranged therein with respect to such elements so as to be placed under dynamic longitudinal stress, i.e. corresponding to vibratory drill bit displacement shock or load, upon such displacement of the elements.

Significantly, the shock absorbing means possesses the characteristic of being capable of supportively absorbing strain in internal direction, e.g. longitudinally, and substantially within the confines of its three dimensional perimetric shape to reduce its normal volume, and concordantly increase its density, substantially without expansion, e.g. lateral bulging, or deformation, e.g. extruding, in external direction outside of the confines of its said shape when placed under pressure or load, e.g. exerted in longitudinal or axial direction, and of returning to its original or normal volume when such pressure or load is released or relieved.

In essence, the instant shock absorbing means comprises resilient material, compressible within itself, i.e. longitudinally compressible within itself when placed under corresponding longitudinally directed pressure or load, essentially without crosswise or lateral distention, swelling, bulging, extruding, or other type expansion or deformation.

The shock absorbing means may be provided at least in composite part in the form of externally non-flowable or non-extrudable, firm, preformed solid means of structural integrity and mechanical stability. It is preferably pliable in nature as distinguished from rigid or hand as inherently contemplated for the plastic component according to the aforesaid U.S. Pat. No. 3,323,327 to Leathers et al. For instance, the shock absorbing means may take the form of a one-piece longitudinal member, a plurality of individual sub-members such as washers or sleeves stacked to provide a composite linearly additive supportive longitudinal member, or a helically extending pliable rope compacted onto itself to provide a composite spirally additive supportive longitudinal member. Other geometical and structural forms may also be provided as desired, as the artisan will appreciate.

Advantageously, by reason of the fact that the shock absorbing means is effectively normally maintained in substantially constant lateral or radial, especially tight, abutting contact and inter-supportive engagement with at least a part, and suitably the entirety, of at least one and preferably both of the adjacent wall portions of the elements, such shock absorbing means will serve to transfer heat thereto, contribute to the lateral or radial supportive interconnection of the longitudinally reciprocating elements, and enhance the sealing relation therebetween. Thus, the shock absorbing means may be sized to contact abuttingly the appropriate longitudinal wall portion of the mandrel or of the housing or of both along their common extent whereby to achieve such heat transfer, supportive interconnection and sealing relation as the case may be.

Preferably, the shock absorbing means when comprising such individual sub-members, may be provided as an enhancing heat conducting composite assembly in the specific form of a plurality of such individual non-metallic, e.g. elastomeric, washers stacked in interleaved arrangement with individual heat conducting, especially metallic, comparatively rigid spacers selectively dimensioned and disposed in operative heat conductive contact with at least a longitudinal portion of the confining surface of the work chamber adjacent thereto for transferring heat more effectively to the work chamber, whereby to provide a corresponding composite interleaved additive supportive longitudinal member.

In accordance with a desirable aspect of the invention, the shock absorbing means possesses the specific characteristic of being capable of resisting or withstanding sustained temperatures up to at least about 400° F. without significant functional deterioration or degradation in internal compressibility, resiliency and/or self-sustaining three dimensional perimetric shape. The shock absorbing means in this regard advantageously comprises an elastomeric material, e.g. a pliable solid form material of self-sustaining shape as distinguished from a liquid form material or a gaseous form material, in normal physical state, such as silicone rubber material of the conventional type, and in particular dimethyl silicone rubber.

This elastomeric solid type of shock absorbing material will inherently possess advantageously the further specific characteristic of being capable, when completely confined and placed under dynamic stress, e.g. in longitudinal or axial direction, of reducing its composite volume in excess of about 2.6% at a stress load of 5000 psi and up to about 11.5% at a stress load of 20,000 psi, and correspondingly of returning to its original or normal volume when the stress load is released or relieved.

It will be realized that while opposed selectively longitudinally spaced apart stop means are conveniently provided on the pair of elements for selectively limiting the maximum and minimum range of their relative reciprocal displacement longitudinally, the shock absorbing means is intended to be disposed in operative longitudinally squeezable contact between opposed stress exerting means such as cross-wise or transverse wall portions or shoulders or the like respectively provided on the pair of elements in spaced apart longitudinal relation. Accordingly, the full longitudinal extent of the shock absorbing means is readily available, in both spatially immediate and functionally immediate relation to such opposed cross-wise portions, for instantaneous response to any such relative longitudinal or axial squeezing movement of the opposed cross-wise portions, generally independently of the other dimensions of the working chamber.

The shock absorbing means in accordance with a preferred aspect of the invention desirably essentially completely fills the interior of the work chamber at maximum volume in constant intersupportive engagement with the confining surface thereof i.e. not only in longitudinal or axial direction but also in cross-wise lateral or radial direction for maximum efficiency. Hence, the shock absorbing means will preferably be disposed in operative contiguous contact with the full longitudinal and cross-wise extent of the confining surface of the work chamber, e.g. sufficiently to enhance energy dissipation by heat transfer thereat. This will simultaneously also contribute to the radial supportive interconnection of the longitudinally reciprocating parts and enhance the radial sealing relation between such parts by acting as an enlarged seal between the pair of longitudinal elements, as noted above.

A further preferred aspect of the invention concerns the maintaining of the shock absorbing means in the work chamber in a confined path of a liquid having a substantially, preferably essentially, equivalent or concordant volume reduction thereto under dynamic stress, such as a conventional corresponding silicone oil, whereby to provide additionally for attendant heat conduction and dissipation, lubrication of vicinal slidably abutting parts and filling of any void spaces within the confines of the work chamber.

In accordance with an optional, yet preferred, feature of the invention combination, indirect pressure flow-communicating means are provided for operatively pressure balancing or equalizing the shock absorbing means with respect to an extraneous reference pressure. Such indirect pressure flow-communicating means may indirectly flow-communicate the work chamber with the exterior of the device for operatively pressure balancing or equalizing the shock absorbing means with respect to the ambient hydrostatic pressure in the well bore.

In particular, such indirect pressure flow-communicating means may include a bilateral floater seal operatively disposed between the pair of associated elements, a confined liquid filled flow path indirectly pressure flow-communicating one side of the floater seal with the work chamber, and an externally open flow path directly pressure flow-communicating the other or opposite side of the floater seal with the exterior of the device.

Preferably, removable static closure seal means are provided for alternatively closing off indirect pressure flow-communication between at least a portion of the confined liquid filled flow path on such one side of the floater seal and the work chamber, and in turn operatively isolating the work chamber from the ambient hydrostatic pressure in the well bore, or other source of extraneous reference pressure, as the case may be.

In connection with an advantageous preferred combination arrangement according to the invention, designed to achieve enhanced operation under hydrostatic and/or hydraulic pressure balancing or equalizing conditions, and with facilitated energy transmission and dissipation, and efficient sliding relation of the coacting parts, the shock absorbing means, e.g. silicone rubber, is maintained in the work chamber in a confined bath of such liquid, e.g. silicone oil, having a substantially equivalent or compatibly concordant volume reduction thereto under dynamic stress for attendant heat conduction, lubrication and filling of any such void spaces within the confines of the work chamber. Such bath of liquid is maintained in indirect pressure flow-communication with and preferably constitutes the same liquid as that in the confined liquid filled flow path indirectly pressure flow-communicating such one side of the floater seal with the work chamber.

In any case, suitable provision is made for locating isolating seal means operatively between the pair of elements for maintaining the shock absorbing means within the work chamber in sealed condition isolated from drilling fluid supply flow and ambient drilling fluid or mud in the well bore.

As regards a further desirable aspect of the combination arrangement of the present invention, the pair of associated elements is provided in the form of a pair of internested telescopingly slidably arranged tubular elements having a central drilling fluid supply bore defined through the inner telescoping element from one end thereof constituting a supply end or upper end to the other end thereof constituting a discharge end or lower end. In this spatial arrangement, a piston working face is provided at the supply end of the inner element peripherally bounded by the confining interior of the outer telescoping element which constitutes a cooperating cylinder therefor.

In this way, relative displacement longitudinally of such elements may be effected tending to pump apart such elements under a driving force corresponding to the dynamic hydraulic flow of drilling fluid supply through such central bore and acting as a pressure head against such piston working face in a direction from such supply end to such discharge end, e.g. for counter-acting opposing forces acting cumulatively as a pressure head in the opposite direction.

Accordingly, the shock absorbing means may be concordantly longitudinally directionally interposed and arranged operatively within the working chamber to be relieved of such opposing forces acting in the opposite direction to the extent of the driving force of such dynamic flow of the drilling fluid supply.

Referring to the drawing, and especially FIGS. 1*a* and 1*b*, a well bore drill string shock absorber device 1 is shown, which is useable for absorbing drill bit vibratory displacement shock. Device 1 includes a pair of internested and telescopingly slidably associated tubular or hollow annular longitudinal elements, preferably in the form of an inner mandrel 2 and an outer housing 3, coaxially extending along a common longitudinal axis 4.

Mandrel 2 contains an upper wash pipe section 5 and a lower bit sub section 6, interconnected by threads at threaded portion 7 which is protected from entry of extraneous fluids by conventional sealing ring 8. The mandrel has a lower connection end 9 on bit sub section 6 provided e.g. with a male threaded portion 9*a* for connecting the mandrel to a drill bit (not shown) for operative disposition therebelow in tandem in a well bore down hole bottom end for carrying out the intended drilling operation. The mandrel also has an upper telescoping insertion end 11 provided with an abutment end face 12 and a central drilling fluid supply bore 13 extending coaxially completely therethrough.

Housing 3 contains in tandem an upper collar sub section 14, an upper middle shock sleeve housing section 15, a lower middle drive pin housing section 16, and a lower floater housing section 17. These housing sections 14 to 17 are interconnected by threads at corresponding threaded portions 18, 19 and 20, respectively similarly protected from entry of extraneous fluids by conventional sealing rings 21, 22 and 23.

The angularly offset radial, or more precisely frusto-conical, orientation of the opposed abutment end faces or tapered lands between the mandrel wash pipe section 5 and bit sub section 6 at 10, and between the housing sections at 24, 25 and 26, as the case may be, enhances advantageously the structural and sealing integrity between these annular parts, inherently preventing axial wobble or radial play therebetween.

The housing 3 has a corresponding upper connection end 27 on collar sub section 14 provided, e.g. with a female threaded portion 27*a* for connecting the housing to a component of a drill string (not shown) for operative disposition thereabove in tandem in the well bore.

Such drill string arrangement is conventionally suspended in the well bore under tension from a supporting line or cable suitably connected at the ground surface or off-shore surface in the usual manner to raise, lower and position the drill string, shock absorber device, drill bit, and any other components or tools necessary to carry out the well bore drilling operation. The drill string, in more or less static suspended disposition in the well bore, contributes its weight to the system, whereby to urge the drill bit operatively into drilling engagement with the stratum or formation being worked for greater efficiency, as the drill string and in turn the drill bit are rotated via the rig apparatus in the conventional manner.

The interposed shock absorber device is positioned to take up vibratory displacement shock caused as the drill bit rotates in the down hole bottom end, and thus suppress the adverse forces otherwise generated through the drill string components, the supporting line or cable and the correspondingly associated apparatus at the rig end located on the ground surface or off-shore surface thereabove.

The housing 3 also has a lower telescoping receiving end 28 at floater housing section 17 into which the mandrel 2 is slidably inserted at bit sub section 6, as well as a slidingly embracing central or coaxial reception bore 29 of staggered increasing or stepped radius in the direction from lower end 28 to upper end 27, i.e. along the various axially extending portions of floater housing section 17, drive pin housing section 16, shock sleeve housing section 15, and collar sub section 14. The stepped radius of housing bore 29 is provided to accommodate the complemental stepped radius portions along the extent of the exterior 30 of the inner mandrel 2, as will be more fully appreciated hereinafter.

End face 28*a* on the housing lower end 28 and opposed end face 6*a* on mandrel bit sub section 6 are of any desired configuration and are selectively spaced apart to act as ultimate stops limiting maximum inward telescoping movement of the mandrel into the housing. This will prevent adverse abutting of any internal parts of the device should maximum inward displacement of the elements occur, i.e. exceeding the shock absorbing limits of the shock absorbing means provided.

A reduced radius entrance portion 31 is provided in housing bore 29, at collar sub section 14, which inwardly terminates in an internal housing end face 32. Advantageously, end face 32 is selectively axially positioned within bore 29 in sufficiently extended spaced relation to internal mandrel end face 12 as compared to the narrower spacing between external end faces 28*a* and 6*a* to avoid abutment between such internal end faces 32 and 12, should maximum inward displacement occur between mandrel 2 and housing 3. Reduced radius portion 31 is provided with a radius which corresponds to that of the mandrel bore 13 to achieve uniformity of flow of drilling fluid supplied by conventional means through the drill string thereto for discharge through the lower end 9 of the mandrel into the active drilling site at the drill bit therebelow.

The mandrel exterior 30 and housing bore 29, at drive pin housing section 16, are provided with a plurality of radially aligned and axially extending sets of cooperating longitudinal coacting pin receiving spline portions defined therein in circumferentially spaced apart relation to each other, including female semi-cylindrical mandrel splines 33 and housing splines 34 (see FIG. 2). The mandrel splines 33 are provided advantageously with axially outwardly limiting semi-cylindrical aligned end shoulders or displacement stops 35 selectively axially positioned therein in normal relation to the position of the housing end face 32, as shown (see FIG. 1*a*), whereas the opposite ends 36 of the mandrel splines are open.

Radial torque drive pins 37 of longitudinal cylindrical configuration are operatively disposed correspondingly in such sets of splines 33 and 34 axially outwardly of the mandrel end shoulders or displacement stops 35 in the direction of the lower end 9 of the mandrel. Drive pins 37 are of complemental male radial dimension to that of the sets of semi-cylindrical splines 33 and 34 for proper seating therebetween.

By reason of the presence of semi-cylindrical aligned housing end shoulders 38 and the corresponding opposed end shoulders 39 defining the longitudinal boundaries of the housing splines 34, the drive pins are advantageously maintained in substantially fixed radial and axial relation to the housing 3. On the other hand, by reason of the presence of the mandrel spline end shoulders or displacement stops 35 and the corresponding open ends 36 of the mandrel splines 33, the drive pins are advantageously maintained in substantially fixed radial relation yet in relative sliding axial relation to the mandrel 2.

The drive pins 37 therefore serve to interconnect interengagingly the housing 3 and mandrel 2 for common rotation about longitudinal axis 4, and for selectively limited relative reciprocal displacement longitudinally with respect to each other along such axis, i.e. between an outward maximum limiting position, in the direction of the drill bit, at which the mandrel spline displacement stops 35 operatively engage the adjacent ends of the drive pins, which are fixed in relation to housing 3 by reason of housing shoulders 38 and 39, and an ultimate inward maximum limiting position, in the direction of the drill string, at which the external mandrel end face 6*a* can operatively engage the external housing end face 28*a*. The latter will occur before internal mandrel end face 12 reaches internal housing end face 32, as noted above.

Of course, as the artisan will appreciate, other outward and inward maximum limiting position stop means may be provided operatively between the mandrel and housing for selectively limiting relative reciprocal displacement longitudinally of such telescopingly slidably associated elements with respect to each other along such axis. In the same way, the housing splines may be provided alternatively with means to permit relative sliding axial movement thereof with respect to the drive pins while the mandrel splines provide for a fixed axial relation thereof with respect to such drive pins.

In any case, the mandrel splines 33 and housing splines 34 provide the desired interconnection with the interpositioned drive pins 37 for imparting rotational torque exerted from above via the drill string and housing 3 through the drive pins 37 to the mandrel 2 and in turn downwardly onto the drill bit, although as will be readily understood, other constructional means may be provided for achieving such rotationally fixed and limitedly longitudinally reciprocally slidable relation between the pair of associated elements.

It will be realized, in connection with the disposition of the instant shock absorbing means, that the operative reciprocating stroke of the mandrel in the housing under drill bit vibratory displacement shock service loads is normally shorter than the selective distance between the unloaded or normal position of the mandrel in the housing as shown and the maximum rearward or upward displacement position at which the exterior mandrel end face 6*a* would reach the exterior housing end face 28*a*.

To protect the integrity of the slidable relation between the mandrel exterior 30 and the housing bore 29 in any position of movement thereof, a wash pipe section annular seal 40 may be provided at the upper end 11 of mandrel 2 and maintained in proper seating relation by a locating annular sealing nut 41 in end face 12.

In order to accommodate the shock absorbing means, the mandrel exterior 30 and housing bore 29, at shock sleeve housing section 15, are provided with cooperating confinement wall portions, including opposed axially extending and radially confining cylindrical side walls 42 and 43 respectively, and opposed radially extending and axially confining annular stress exerting shoulders or end walls 44 and 45, respectively. Mandrel side wall 42 and end wall 44 as well as housing side wall 43 and end wall 45 together define an annular cylindrical longitudinal shock absorber work chamber 46 therewithin of longitudinally varying and radially constant selective maximum and minimum longitudinal dimension and corresponding maximum and minimum volume in dependence upon the selectively limited reciprocal displacement of the mandrel 2 and housing 3 with respect to each other and in turn the corresponding relative longitudinal displacement of such annular end walls 44 and 45 toward and away from each other.

Significantly, temporarily internally compressible and resilient shock absorbing means, such as pliable elastomer 47, and particularly silicone rubber material, of self-sustaining selective three dimensional perimetric annular shape, e.g. hollow cylindrical shape, having a normal volume when confined within and operatively occupying, e.g. essentially completely, the longitudinal extent of the interior of the work chamber 46 at maximum longitudinal dimension and corresponding volume thereof, as shown, is arranged in the work chamber. Shock absorbing means 47 is shown as a one-piece longitudinal member. It is advantageously arranged in work chamber 46 in tightly abutting operative sliding surface contact with at least a portion of, and preferably both of, the cylindrical side walls 42 and 43, as shown, but in any case is in operative contact with both of the annular end walls 44 and 45 when such end walls or shoulders are spaced apart a linear distance corresponding to the maximum longitudinal dimension and corresponding volume of the work chamber.

In this way, the shock absorbing means 47 may be directly placed under dynamic longitudinal stress corresponding to vibratory drill bit axial displacement shock or load upon corresponding relative reciprocal displacement of the mandrel and housing during rotation of the device while drilling is being carried out. Accordingly, transmission of violent axial forces from the drill bit to the drill string and associated parts of the system thereabove is suppressed as well as attendant vibration, chatter, etc., due to the efficient damping function of the instant shock absorbing means 47, especially where the same is maintained in a three dimensional perimetric form in which, as shown, its lateral or radial portions are normally maintained in constant bilateral or radial inter-supportive, sealing and heat conducting common abutting contact with both of the side walls 42 and 43 throughout their extent.

The shock absorbing means 47 is thus preferably of substantially complemental hollow cylindrical normal dimensions to those of the mandrel side wall 42 and housing side wall 43 which define the corresponding maximum three dimensional perimetric boundaries of the work chamber 46 for contiguous contact therebetween as shown. Hence, heat generated within the shock absorbing means 47, due to the formation temperature and the mechanical energy of the shock vibrations, is transferred by conduction directly from the shock absorbing means 47 to the work chamber for eventual dissipation through the body of the device, e.g.

to the drill fluid in the mandrel bore 13 and/or to the ambient drilling mud in the well bore depending on whether the shock absorbing means 47 is in corresponding abutting contact with wall 42 and/or wall 43, as the case may be. All energy stored in the shock absorbing means under internal compression is thus transferred directly through the chamber walls by conduction and via friction heat dissipation. At the same time, such constant contact provides for direct supportive interconnection and positive sealing between the mandrel and housing as noted above.

Advantageously, the shock absorbing means, e.g. a solid elastomer 47 such as silicone rubber material, according to the invention, is selected such that it is inherently capable of supportively absorbing strain in internal direction and within the confines of its three dimensional perimetric shape, especially in lateral or radial direction, so as to reduce its normal volume and concordantly increase its density without expansion, e.g. crosswise outward lateral or radial distention, swelling, bulging, or deformation, e.g. extruding, in external direction, and within such confines of its said shape when placed under pressure or load and of returning to its original or normal volume when such pressure is released. It thus constitutes a non-flowable, firm, preformed solid means of structural integrity and mechanical stability.

Significantly, in this regard, due to the laterally outwardly non-deformable and longitudinally internally compressible characteristic of the instant shock absorbing means 47, as arranged in chamber 46, the preferred sliding abutment contact relation thereof with the adjacent surface portions of both of the side walls 42 and 43 will in maximum manner provide, mutually, support of the shock absorbing means 47 by the side walls 42 and 43 and counter-support of the side walls 42 and 43 by the shock absorbing means 47, i.e. in lateral or crosswise direction. This essentially contiguous positional relationship thereby renders the sliding contact between these parts both inter-supportive and heat conducting, such that localized lateral or radial displacement temporarily between mandrel 2 and housing 3 and concomitant cross-wise stress exerted, e.g. tangentally, on the shock absorbing means 47 to locally internally compress the same, will be counteracted by corresponding cross-wise supportively absorbed strain and concomitantly more intense heat transfer thereat. The tight radial connection thereby also provided of course allows the shock absorbing means 47 to serve as a dynamic seal as well advantageously functionally interconnecting the mandrel 2 and housing 3.

Desirably, the shoulders or end walls 44 and 45 are further provided with an appropriate isolating dynamic seal means and compression means assembly to protect the structural integrity of the coacting parts, considering the potentially high longitudinally upward or axial forces to which such parts may be exposed during the drilling operation. Specifically, opposed annular rubber seals 48,48 may be placed in contact with the axial end portions of the shock absorbing means 47, then opposed annular lead compression rings 49,49 inserted outwardly thereagainst, and finally opposed annular steel compression rings 50,50 may be placed outwardly of the lead rings to complete the composite arrangement.

This robust isolating seal means and compression means assembly at each opposed end of the shock absorbing means will insure proper functional disposition of the shock absorbing means, good liquid tight sealing relation between the mandrel and housing portions thereat, and effective sliding disposition of the parts along this portion of the device, under the high forces transmitted collectively therealong and therethrough between the longitudinally opposed shoulders or end walls 44 and 45. The cumulative, more or less pronouncedly axially extended, longitudinal dimension of this isolating seal means and compression means assembly in relation to its corresponding radial or transverse dimension provides the advantage of a selectively thick composite annular liquid tight pressure supporting interface plug at each longitudinal end of the shock absorbing material 47 for accommodating in a comparatively long-lasting manner the dynamic longitudinal stress exerted on the system during repeated shock absorbing action.

It is particularly surprising that the instant type elastomer, e.g. dimethyl silicone rubber or similar silicone rubber material, is advantageously capable of resisting sustained temperatures up to at least about 400° F., in the shock absorber device as shown, without significant functional degradation in internal compressibility, resiliency and self-sustaining three dimensional perimetric shape, despite its tight abutting disposition with the work chamber walls. For example, even at such elevated ambient formation temperatures under vibratory drill bit displacement shock service conditions, the shock absorbing means in question is inherently capable, when completely confined and placed under dynamic stress in the work chamber arrangement provided, of reducing its volume in excess of about 2.6% at a stress load of 5000 psi and up to about 11.5% at a stress load of 20,000 psi, and correspondingly of returning to its original volume when the stress load is released or relieved, whether such load is mechanical, hydraulic or pneumatic in origin.

The shock absorbing means 47, as show, thus preferably essentially completely fills the interior of the work chamber 46 at maximum volume in inter-supportive engagement therewith whereby to enhance heat dissipation through the wall surfaces of the work chamber especially along the common axial extent of the abutting contact therebetween. However, as a further desirable aspect of the invention, the shock absorbing means 47 is maintained in the work chamber 46 in a confined bath of liquid schematically indicated at 51 (see FIG. 1*a*), having a substantially equivalent volume reduction thereto under dynamic stress. Such liquid may comprise advantageously a corresponding conventional silicone oil.

The presence of such bath of liquid 51 enhances attendant heat conduction, serves to lubricate the relatively reciprocating parts in common contact at the work chamber 46, and provides for the essentially complete filling of any void spaces which may be present within the confines of the work chamber for more uniform and predictable performance. By reason of the liquid tight relation and isolating nature of the opposed sets of seals and compression rings 48, 49 and 50 at the longitudinal ends of work chamber 46, such bath of liquid 51 is confined within the work chamber in corresponding liquid tight condition.

An indirect pressure flow-communicating means in the form of a floater seal arrangement may be provided suitably between the mandrel exterior 30 and housing bore 29, at floater housing section 17, for advantageously operatively pressure balancing or equalizing the shock absorbing means with respect to an extraneous reference pressure, here constituted by the ambient hydrostatic pressure in the well bore at the down hole bottom end where the drill bit is located. A conventional bilateral annular floater seal 52 is operatively slidably disposed between the mandrel 2 and housing 3 in the annular floater chamber 53 defined thereat. The confined liquid filled flow path 54 defined between the mandrel exterior 30 and the housing bore 29, and extending from the floater chamber 53 to the work chamber 46, indirectly pressure flow-communicates the adjacent side 55 of floater seal 52 with the work chamber via the interposed corresponding set of the isolating seals and compression rings 48, 49 and 50. The mud vents or ports 56 defined in the floater housing section 17 provide an externally open flow path directly pressure flow-communicating the other or remote side 57 of floater seal 52 with the ambient hydrostatic pressure at the exterior of the device.

Because of the floating slidable disposition of the mandrel bit sub section 6 within the lower end 28 of the floater housing section 17, i.e. in relatively uncritical fluid loose as opposed to fluid tight relation therewith, an annular piston face is thereby presented in floater chamber 53, which under the open flow conditions provided by the ports 56 and at the exposed portion of such bit sub section 6 outwardly or downwardly of such lower end 28, serves to equalize the external hydrostatic or hydraulic pressure in all directions as between the mandrel and housing. Because of the indirect pressure flow-communication provided by flow-path 54 in conjunction with the floater seal 52, such arrangement serves to equalize that pressure as well in relation to the shock absorbing means 47. Accordingly, the shock absorbing means is placed under or pre-loaded with an equalizing reference pressure corresponding to such ambient pressure.

Preferably, in this regard, the liquid in flow path 54 is the same liquid 51 as maintained in work chamber 46, e.g. silicone oil having a substantially equivalent volume reduction to that of the shock abosrbing means 47 under dynamic stress, for uniformity and predictability in overall performance.

Should excessive ambient hydrostatic pressures be encountered, such that the shock absorbing means is placed under an undesired longitudinal stress corresponding thereto which detracts from the strain absorbing reserve of the shock absorbing means, e.g. as when the device 1 is to be used at extreme depths where the fluid head on the elastomeric material would compress the same unduly increasing the density thereof and concomitantly decreasing the resilience thereof and concordant shock absorbing power, an alternative provision can be made as shown in FIG. 3. Specifically, by way of modification, the housing 3, for instance at the end portion 58 (see FIG. 1*b*) of drive pin housing section 16 adjacent housing bore 29, may be provided with an annular recess 59 containing a preferably removable annular static closure seal 60, suitably removably locked in position by a conventional snap ring 61 or the like, for maintaining a liquid tight slidably sealing engagement between housing bore 29 and the mandrel exterior 30 along the adjacent portion of the wash pipe section 5 of the mandrel 2 (see FIG. 3). Static seal 60 may of course be located selectively anywhere along flow path 54 for the desired purposes, as the artisan will appreciate.

Static seal 60 effectively serves to close off indirect pressure flow-communication between the flow path 54 and work chamber 46, and the floater seal 52 is correspondingly maintained in non-movable or fixed position with respect to floater housing section 17. This isolates the work chamber and in turn the shock absorbing means 47 from the ambient hydrostatic or other pressure in the well bore acting on the opposite side 57 of the floater seal 52. Nevertheless, desirably such floater seal 52 is sufficiently robust to withstand the differential pressures involved and still maintain a liquid tight seal thereat between mandrel 2 and housing 3, whether static seal 60 is included or omitted.

It will be noted also, that flow path 54 extends around drive pins 37 (see FIG. 2) in the splines 33 and 34 and throughout the adjacent annular space between the mandrel exterior 30 and the housing bore 29 to maintain the drive pins as well as the mandrel and housing under the balancing pressure of the body of liquid such as silicone oil which fills such flow path spaces. The filling with liquid is accomplished by simply removing plug 62 threadedly seated in radial bore 63 of floater housing section 17 for this purpose.

As a countervailing factor, with respect to the ambient hydrostatic reference pressure operatively exerted via float seal 52 onto the shock absorbing means, mandrel end face 12 may suitably serve as a piston working face bounded by the confining interior of housing bore 29 thereat which constitutes a cooperating cylinder therefore, whereby to exert an offsetting driving force corresponding to the flow of drilling fluid supply (not shown) passing downwardly from the drill string through the reduced radius portion 31 of housing bore 29 and striking mandrel end face 12 prior to continued flow thereof through mandrel bore 13 for discharge from the lower end 9 onto the drill bit and the surrounding well bore down hole bottom end area thereat. To the extent that such hydraulic supply downward driving force is exerted, tending to pump open the mandrel with respect to the housing, the same will counteract the upwardly opposing forces, i.e. in the opposite direction, attributable to the ambient hydrostatic pressure in the well bore as well as to the bit shock, and relieve the longitudinally directionally interposed and arranged shock absorbing means from the latter reference pressure or pressures as the case may be to a corresponding contributing degree.

In accordance with the alternative modification shown in FIG. 4, the shock absorbing means may be provided in the form of a plurality of individual submembers, e.g. annular washers or sleeves 64, of selective thickness or axial height, stacked to provide a composite linearly additive supportive annular cylindrical longitudinal member, instead of the one-piece member 47 shown in FIG. 1*a*. The washers 64, e.g. flat thin rings of elastomeric material such as silicone rubber material, may be of preferably substantially right rectangular selective dimensional cross-sectional shape, and together collectively provide a composite member of normal dimensions similarly substantially complemental to those of the annular cylindrical longitudinal work chamber 46, i.e. at maximum longitudinal dimension and corresponding volume.

From the schematic indication of the corresponding orientation of the stack of washers 64 in relation to the adjacent cylindrical side walls 42 and 43 of the work chamber 46, as shown in FIG. 4, i.e. in terms of the selective lateral breadth or radial width orientation of such washers, it will be seen that they are likewise disposed in operative inter-supportive, sealing and heat conductive contact with the adjacent longitudinal portion of the corresponding confining surface of the work chamber 46 contiguous therewith. A bath of liquid 51 may be correspondingly used in work chamber 46 in this embodiment as well.

A similar relationship with respect to the corresponding walls 42 and 43 of the work chamber 46 is contemplated in the further alternative modification shown in FIG. 5, in which the shock absorbing means is provided in the form of a helically extending rope 65, sufficiently pliable for achieving helical orientation thereof, and compacted upon itself to provide a composite spirally additive supportive annular cylindrical longitudinal member. Rope 65, e.g. of elastomeric material such as silicone rubber material, may also be of preferably substantially right rectangular selective dimensional cross-sectional shape similar to that of washers 64. In the same way, rope 65 has normal composite three dimensional perimetric dimensions substantially complemental to those of the annular cylindrical longitudinal work chamber 46 at such maximum longitudinal dimension and corresponding volume, and for this purpose the ends thereof may be suitably tapered more or less to a point as shown schematically at 66 to preserve the right hollow cylinder orientation thereof for proper seating abutment between the end walls 44 and 45, or more precisely between the rubber seals 48,48 in the manner shown in FIG. 1*a*.

From the schematic indication of the corresponding orientation of the helically extending rope 65, preferably a one-piece rope in taut or unslackened condition, in relation to the adjacent cylindrical side walls 42 and 43 of the work chamber 46, as shown in FIG. 5, it will be seen that such rope is also disposed in operative inter-supportive, sealing and heat conductive contact with the adjacent longitudinal portion of the corresponding confining surface of the work chamber 46 essentially contiguous therewith. Where a bath of liquid 51 is provided in work chamber 46, rope 65 may be more conveniently provided of selective dimensional round cross-sectional shape, with any void spaces being filled with such liquid 51.

FIG. 6 depicts an embodiment otherwise comparable to that shown in FIG. 4 but relating to a modified form in which the plurality of individual annular, e.g. elastomeric, washers 64 is stacked in interleaved arrangement with individual heat conducting annular spacers 67, e.g. metallic washers or flat thin rings, selectively compositely dimensioned and disposed in operative inter-supporting, sealing and heat conductive contact with the walls 42 and 43 and thus with the adjacent longitudinal portion of the corresponding confining surface of the work chamber 46, essentially continuous therewith, as schematically shown. More effective transfer of heat to the work chamber is thereby achieved, despite lack of concomitant travel due to the incompressible nature of such relatively rigid spacers 67. This stacked alternating elastomer washer and metallic spacer arrangement provides a composite interleaved additive supportive longitudinal member of cumulative effect. The metallic spacers and elastomer washers may each be of suitable right rectangular selective dimensional cross-sectional shape, preferably of the same or similar shape and size, i.e. in terms of their inside and outside diameters as well as of their thickness or axial height.

Preferably, in the case of the embodiment of FIG. 6, a bath of liquid 51 will be used especially to provide for lubrication between the metal spacers 67 and the side walls 42 and 43 of the work chamber 46.

To assemble the shock absorber device 1, thus described, the selectively sized cylindrical shock absorbing means 47, e.g. enclosed between the opposed sets of seals and compression rings 48, 49 and 50, is slidably forced under slight gripping tension into place on the mandrel exterior 30 from the upper end 11 of wash pipe section 5 and against end wall 44, and then covered over by shock sleeve housing section 15. To achieve such disposition, the latter is slid onto wash pipe section 5 from the opposite end and slidably forced under slight embracing compression over the outer surface of the cylindrical shock absorbing means 47. The procedure is similar for washers 64 with or without interleaved spacers 67 whereas rope 65 will be tautly prewound onto mandrel exterior 30 rather than slidably forced thereon. After drive pins 37 are inserted in the housing splines 34, wash pipe section 5 having the mandrel splines 33 aligned with such pins, is slid downwardly through drive pin housing section 16, and the shock sleeve section 15 is connected thereto at threaded portion 19, keeping such parts vertically oriented during this time. Floater housing section 17 is then slid onto the lower end of wash pipe section 5 and connected to drive pin housing section 16 at threaded portion 20, and floater seal 52 is next positioned in floater chamber 53. After this, mandrel bit sub section 6 may be connected to wash pipe section 5 at the threaded portion 7. Upon slight axial displacement to align pre-loosened threaded vent plug 68 in the threaded vent bore 69 in shock sleeve housing 15 with the adjacent ring 50 on mandrel exterior 30, collar sub section 14 may be connected at threaded portion 18 to shock sleeve housing section 15 in tight relation without any cushioning hinderance from otherwise captive fluids such as air or oil possibly collected thereat, i.e. within the close tolerance areas between the mandrel exterior 30 and the housing bore 29 along the underside of shock sleeve housing 15. As collar sub section 14 is seated in place, ring 50 on mandrel exterior 30 will return to its original position, whereupon vent plug 68 can be retightened in vent bore 69.

It will be noted that the inner face of collar sub section 14 actually constitutes end wall 45 of the work chamber 46, and that captive cushioning fluid thereat may detract from the uniformity and predictability of the desired performance characteristics of the shock absorbing means 47.

Liquid can be added in the conventional manner and in the desired amount via threaded radial bore 63 to fill flow path 54 and the adjacent portion of float chamber 53 facing floater seal side 55, whereupon plug 62 can be inserted in place to provide a fluid tight seal thereat.

Where the work chamber 46 is to contain a bath of liquid for the shock absorbing means 47, the set of the seals and compression rings 48, 49 and 50 adjacent the upper end 11 of the wash pipe section 5 can be left off until after the necessary quantity of liquid has been added. This will occur while the parts are vertically oriented, with vent bore 69 aligned with the facing end of shock absorbing means 47, i.e. before collar sub section 14 is mounted in place. Such set of the seals and compression rings can then be slid into position and collar sub section 14 connected at threaded portion 18. In this instance, vent bore 69 is used particularly to relieve the confined area thereat of any excess liquid collecting as a consequence of the adding of such liquid to work chamber 46 to provide the desired bath for the shock absorbing means 47.

Of course, as the artisan will appreciate, by appropriate selective dimensioning of the set of the seals and compression rings 48, 49 and 50 adjacent the end wall 45 and appropriate device parts, the bath of liquid 51 may extend along mandrel exterior 30 and housing bore 29 to the wash pipe seal 40 and/or along the threaded portion 18 between the shock sleeve housing section 15 and collar sub section 14 to the sealing ring 21 to operatively load or pressure balance seal 40 and/or sealing ring 21 as the case may be with the operating pressure of such liquid 51 in work chamber 46, and similarly to lubricate and slidably pressure balance mandrel 2 and housing 3 along their common extent in the vicinity of the mandrel upper end 11 with such operating pressure of liquid 51.

By similar appropriate selective dimensioning of the other set of the seals and compression rings 48, 49 and 50 adjacent the end wall 44, the bath of liquid 51 may be placed in direct flow-communication with the liquid in flow path 54, and in turn by corresponding selective dimensioning of the appropriate device parts, such liquid may extend along the threaded portions 19 and 20 to the sealing rings 22 and 23 for the same purposes, as the case may be, as noted above.

In any event, the sealing system contemplated for the shock absorber device of the invention will include adequate sealing arrangements for sealing off the functional interior portions thereof from the attendant well fluid for the desired purposes.

It will be realized that in terms of stress or load, expressed in force per unit area, e.g. psi, being proportional to strain or deformation, i.e. change in geometrical form, expressed in elongation or reduction in length per unit original length, shock absorbing power or strain deformation as pertinent hereto depends generally on the volume of the shock absorbing means versus the stress load. The instant shock absorbing means apparently observes this relation in a true sense since it is effectively compressible within itself when subjected to stress, reducing its volume much like a liquid, yet without extruding or expanding, as would a liquid or other type of elastomer inherently such as urethane, as contemplated in the aforesaid U.S. Pat. No. 3,949,150 to Mason et al.

Moreover, as contrasted with other types of elastomers such as urethane which are temperature sensitive, the instant silicone rubber elastomer is temperature resistant. Whereas urethane is generally useable without functional degradation only up to about 180° F. in air and 230° F. in oil, the instant silicone rubber elastomer is specifically useable at sustained high temperatures up to at least about 400° F. for continuous shock absorbing purposes at normally encountered vibratory drill bit shock service loads. Since more wells have ambient formation temperatures above 250° F., and since the extra heat generated during energy absorbing of shock loads will increase such temperatures beyond that level, it is clear that urethane degradation will occur at a comparatively accelerated rate whereas the instant silicone rubber elastomer will durably withstand such elevated temperatures without such accelerated degradation, i.e. at the vibratory shock service loads normally encountered, even though maintained in constant tight abutting contact with the longitudinal confinement wall portions of the reciprocating elements as contrasted with conventional arrangements.

Also, while springs are linear in their compression rate, and while it would appear from said U.S. Pat. No. 3,949,150 to Mason et al that urethane is similarly linear in compression response, absorbing load substantially uniformly throughout its service length, yet being in fact non-compressible although deformable, on the other hand the silicone rubber elastomer of the present invention is not only compressible within itself so as to reduce its volume without extruding or expanding but also would appear to be logarithmic in compression response. Under comparable conditions, while the non-compressible urethane arrangement according to said Mason et al Patent provides at least a 2" travel at an 80,000 lb. load and not more than a 2" travel at a 10,000 lb. load, the instant device employing such internally compressible silicone rubber elastomer can readily achieve a 2.3" travel at an 80,000 lb. load and approximately a 0.473" travel at a 10,000 lb. load.

However, the instant device in actuality provides shock absorbing action at such 80,000 lb. load leading to a 3.4" travel at what amounts to a dynamic 120,000 lb. load as opposed to a static 80,000 lb. load. In this regard, at a drill string collar load of 80,000 lbs. in a semi static condition or a drilling condition where the rock stratum is relatively soft, the bounce or shock amplitude will be about $\frac{1}{8}$" to $\frac{1}{2}$", whereas in rougher drilling where the formation is hard and near to the surface as in shallow well bores, the drill bit may cause the collars to bounce at a shock amplitude as much as $\frac{5}{8}$". This actually develops a rebound impact load on the bit of as much as 1.5 to 2 times the drill string weight, e.g. 120,000 lbs. rather than 80,000 lbs., since the collar load is not the impact load to which the drill bit is subjected but instead a static or potential load as opposed to the kinetic load falling back on the drill bit with each bounce, and this leads to such 3.4" travel result.

In operation, using a device 1 according to the present invention with silicone rubber elastomer as the shock absorbing means 47 and a non-movable floater seal 52 sealed off therefrom by a static seal 60, and having an outside housing diameter of $6\frac{3}{4}$", an inside mandrel bore diameter of 2", a length of 180" (15 ft.), and an approximate weight of 1600 lbs. (725 kg.), operatively coupled to a $7\frac{3}{4}$" diameter drill bit and subjected to a 40,000 lb. collar load (in air), axial deflection or shock amplitude at the same load is 1.2" regardless of the ambient well pressure. When the seal 60 is omitted and the floater seal 52 pre-loads such shock absorbing means in pressure equalizing balance with fluid pressure corresponding to the ambient well pressure, the axial deflection including that contributed by such fluid pressure pre-loading amounts to 2.4" at 5,000 psi, 3.8" at 10,000 psi, 4.9" at 15,000 psi and 5.3" at 20,000 psi. In the latter instance, since the 40,000 lb. collar load only contributes 1.2" of the axial deflection, the excess is due directly to the increase in fluid pressure corresponding to ambient well pressure.

Naturally, the greater the hydrostatic head, the less resilient the shock absorbing means and its shock absorbing effect will become, since its cushioning reserve will accordingly be decreased and its density increased, causing less compression travel when the collar-drill bit load bounce occurs. However, as the artisan will appreciate, wells having hydrostatic heads approaching 20,000 psi are rare, less bounce occurs therein and less collar loads are involved, whereas shock absorber devices are more generally useful and more frequently used at shallow depths of up to about 8,000 feet involving large bits and lower order of magnitude hydrostatic heads. On the other hand, the maximum resiliency can be preserved for full shock absorbing volume reduction action by omitting the floater seal arrangement or providing the system with static seal 60, yet this will tend to subject the dynamic seals in the shock absorbing system to greater pressures amounting in extreme cases for instance to an order of magnitude differential of perhaps 18,000 to 20,000 psi.

Advantageously, nevertheless, by utilizing the end face 12 of the mandrel 2 as a working piston face within housing bore 29, in a shock absorber device having the foregoing dimensions, so as to provide a differential annular piston area thereat, at a given drilling fluid supply flow pump pressure at the upper end 27 of the housing 3, a corresponding pressure drop resulting in an additional shock absorbing advantage can be provided. This will counteract to some extent any such adverse effect caused by the hydrostatic head exerted through the floater seal 52 where static seal 60 is omitted and accordingly counter-load the device to relieve the shock absorbing means to a concomitant extent before the bit bounce comes into play to load such shock absorbing means.

It will be realized that the foregoing specification and drawings are set forth by way of illustration and not limitation, and that various modifications and changes may be made therein without departing from the spirit and scope of the present invention which is to be limited solely by the scope of the appended claims.

What is claimed is:

1. Shock absorber device for use in well bore drilling to absorb drill bit vibratory displacement shock comprising a pair of slidably associated longitudinal elements having cooperating longitudinal coacting portions and cooperating longitudinal confinement wall portions, with one of such elements being operatively connectable to a component of a drill string and the other of such elements being operatively connectable to a drill bit, said elements being interengageably interconnected along such coacting portions for common rotation about a longitudinal axis and for selectively limited relative reciprocal displacement longitudinally with respect to each other along such axis, and temporarily internally compressible and resilient shock absorbing means of substantially self-sustaining selective three dimensional perimetric shape, disposed between such longitudinal confinement wall portions in substantially constant bilateral inter-supportive abutting contact with at least a portion of the common longitudinal extent of both of such wall portions and operatively arranged with respect to such elements to be placed under dynamic longitudinal stress corresponding to vibratory drill bit displacement shock upon such relative reciprocal displacement of the elements and being capable of supportively absorbing strain in internal direction and substantially within the confines of its three dimensional perimetric shape to reduce its starting volume substantially without expansion or deformation in external direction outside of the confines of its three dimensional perimetric shape when placed under pressure and of returning to its starting volume when such pressure is released.

2. Device according to claim 1 wherein the shock absorbing means is in the form of externally non-flowable, firm, preformed, non-metallic solid means of structural integrity and mechanical stability.

3. Device according to claim 1 wherein the shock absorbing means is in the form of a one-piece longitudinal member.

4. Device according to claim 1 wherein the shock absorbing means is in the form of a plurality of individual sub-members stacked to provide a composite linearly additive supportive longitudinal member.

5. Device according to claim 1 wherein the shock absorbing means is in the form of a helically extending rope compacted into itself to provide a composite spirally additive supportive longitudinal member.

6. Device according to claim 1 wherein the shock absorbing means is in the form of a plurality of individual sub-members stacked in interleaved arrangement with individual heat conducting metallic spacers to provide a composite interleaved additive supportive longitudinal member.

7. Device according to claim 1 wherein the shock absorbing means is capable of resisting temperatures up to at least about 400° F. without significant functional degradation in internal compressibility, resiliency and self-sustaining three dimensional perimetric shape.

8. Device according to claim 1 wherein the shock absorbing means includes an elastomeric material.

9. Device according to claim 1 wherein the shock absorbing means includes silicon rubber material.

10. Device according to claim 1 wherein the shock absorbing means is in substantially constant bilateral inter-supportive tight slidingly abutting surface contact with at least a portion of the common longitudinal extent of both of such wall portions.

11. Device according to claim 1 wherein longitudinally opposed and laterally extending stress exerting means are provided on said elements and the shock absorbing means is operatively arranged therebetween to be placed under such dynamic longitudinal stress.

12. Device according to claim 1 wherein said elements together define a shock absorber chamber within such longitudinal confinement wall portions of longitudinally varying selective maximum and minimum operative longitudinal dimension and corresponding volume in dependence upon the selectively limited reciprocal displacement of the elements with respect to each other and in turn the corresponding relative longitudinal displacement of such wall portions, and the temporarily internally compressible and resilient shock absorbing means of self-sustaining selective three-dimensional shape has a normal volume confined within and operatively occupying substantially the operative longitudinal extent of the interior of the work chamber at maximum longitudinal dimension and corresponding volume in substantially constant bilateral inter-supportive slidingly abutting contact with substantially the longitudinal extent of both of such wall portions and is operatively arranged therein with respect to such elements so as to be placed under dynamic longitudinal stress corresponding to vibratory drill bit displacement shock upon relative reciprocal displacement of the elements.

13. Device according to claim 12 wherein the shock absorbing means is capable when completely confined and placed under dynamic stress of reducing its normal volume in excess of about 2.6% at a stress load of 5000 psi and up to about 11.5% at a stress load of 20,000 psi, and correspondingly of returning to its original volume when the stress load is released.

14. Device according to claim 12 wherein the shock absorbing means is maintained in the work chamber in a confined bath of a liquid having a substantially equivalent volume reduction thereto under dynamic stress for attendant heat conduction, lubrication and filling of any void spaces within the confines of the work chamber.

15. Device according to claim 12 wherein the shock absorbing means is disposed in constant operative common abutting contact with substantially the entire longitudinal portions of the corresponding confining surfaces of the work chamber.

16. Device according to claim 12 wherein the shock absorbing means essentially completely fills the interior of the work chamber at maximum volume in constant contiguous intersupportive and sealing engagement with the confining surfaces thereof.

17. Device according to claim 12 wherein indirect pressure flow-communicating means are provided for operatively balancing the shock absorbing means with respect to an extraneous reference pressure.

18. Device according to claim 17 wherein said indirect pressure flow-communicating means indirectly flow-communicate the work chamber with the exterior of the device for operatively balancing the shock absorbing means with respect to the ambient hydrostatic pressure in the well bore.

19. Device according to claim 18 wherein said indirect pressure flow-communicating means include a bilateral floater seal operatively disposed between the elements, a confined liquid filled flow path indirectly pressure flow-communicating one side of the floater seal with the work chamber, and an externally open flow path directly pressure flow-communicating the other side of the floater seal with the exterior of the device.

20. Device according to claim 19 wherein removable static closure seal means are provided for closing off indirect pressure flow-communication between at least a portion of the confined liquid filled flow path on such one side of the floater seal and the work chamber, and isolating the work chamber from the ambient hydrostatic pressue in the well bore.

21. Device according to claim 19 wherein the shock absorbing means is maintained in the work chamber in a confined bath of liquid having a substantially equivalent volume reduction thereto under dynamic stress for attendant heat conduction, lubrication and filling of any void spaces within the confines of the work chamber, and such bath of liquid is in indirect pressure flow communicating with and constitutes the same liquid as that in the confined liquid filled flow path indirectly pressure flow-communicating such one side of the floater seal with the work chamber.

22. Device according to claim 21 wherein such liquid is a silicon oil.

23. Device according to claim 12 wherein isolating seal means are provided for maintaining the shock absorbing means within the work chamber in sealed condition isolated from drilling fluid supply flow and ambient drilling fluid in the well bore.

24. Device according to claim 12 wherein the elements are provided in the form of a pair of internested telescopingly arranged tubular elements having a central drilling fluid supply bore defined through the inner telescoping element from one end thereof constituting a supply end to the other end thereof constituting a discharge end, and providing at the supply end of such inner element a piston working face peripherally bounded by the confining interior of the outer telescoping element which constitutes a cooperating cylinder therefore, whereby to effect relative displacement longitudinally of such elements under a driving force corresponding to the flow of drilling fluid supply through such central bore and acting against such piston working face in a direction from such supply end to such discharge end for counteracting opposing forces acting in the opposite direction.

25. Device according to claim 24 wherein the shock absorbing means is longitudinally directionally interposed and arranged operatively within the working chamber to be relieved of such opposing forces acting in the opposite direction to the extent of the driving force of such flow of the drilling fluid supply.

26. Device according to claim 12 wherein the confinement wall portions include corresponding opposed transverse shoulder means on the respective elements in longitudinally spaced apart facing relation and longitudinally confining the shock absorbing means operatively therebetween for exerting such dynamic longitudinal stress against the shock absorbing means.

27. Device according to claim 12 wherein the elements include an inner mandrel and a tubular outer housing in telescopingly associated relation and having cooperating confinement wall portions together defining an annular shock absorber work chamber therewithin of longitudinally varying selective maximum and minimum longitudinal dimension and corresponding volume in dependence upon the selectively limited reciprocal displacement of the mandrel and housing with respect to each other.

28. Device according to claim 12 wherein the elements are in the form of a pair of telescopingly associated tubular annular longitudinal elements including an inner mandrel and an outer housing having a mandrel receiving bore, the mandrel exterior and housing bore having cooperating confinement wall portions including opposed axially extending and radially confining cylindrical side walls and opposed radially extending and axially confining annular end walls together defining an annular cylindrical longitudinal shock absorber work chamber therewithin of longitudinally varying and radially constant selective maximum and minimum longitudinal dimension and corresponding volume in dependence upon the selectively limited reciprocal displacement of the mandrel and housing with respect to each other and in turn the corresponding longitudinal displacement of such annular end walls toward and away from each other.

29. Device according to claim 28 wherein the shock absorbing means is in the form of a one-piece elastomeric annular cylindrical longitudinal member of normal dimensions substantially complemental to those of the annular cylindrical longitudinal work chamber at maximum longitudinal dimension and corresponding volume.

30. Device according to claim 28 wherein the shock absorbing means is in the form of a plurality of individual elastomeric annular washers stacked to provide a composite linearly additive supportive annular cylindrical longitudinal member of normal dimensions substantially complemental to those of the annular cylindrical longitudinal work chamber at maximum longitudinal dimension and corresponding volume.

31. Device according to claim 28 wherein the shock absorbing means is in the form of a helically extending pliable elastomeric rope compacted onto itself to provide a composite spirally additive supportive annular cylindrical longitudinal member of normal dimensions substantially complemental to those of the annular cylindrical longitudinal work chamber at maximum longitudinal dimension and corresponding volume.

32. Device according to claim 28 wherein the shock absorbing means is in the form of a plurality of individual elastomeric annular washers stacked in alternating interleaved arrangement with individual annular heat conducting metallic spacers, such elastomeric washers and metallic spacers having substantially the same size and shape and being commonly selectively radially dimensioned and disposed in operative heat conductive contact with at least a longitudinal portion of the confining surface of the cylindrical side walls of the work chamber adjacent thereto for transferring heat to the work chamber therefrom, whereby to provide a composite interleaved linearly additive supportive annular cylindrical longitudinal member of normal dimensions substantially complemental to those of the annular cylindrical longitudinal work chamber at maximum longitudinal dimension and corresponding volume.

33. Shock absorber device according to claim 1 for use in well bore drilling to absorb drill bit vibratory displacement shock comprising a pair of telescopingly slidably associated tubular annular longitudinal elements extending along a common longitudinal axis, including an innar mandrel having a lower connection end for connecting the mandrel to a drill bit, an upper telescoping insertion end provided with an abutment end face and a central drilling fluid supply bore, and an outer housing having a corresponding upper connection end for connecting the housing to a component of a drill string, a lower telescoping receiving end and a slidingly embracing reception bore, the mandrel exterior and housing bore having a plurality of radially aligned and axially extending sets of cooperating longitudinal coacting pin receiving spline portions defined therein in circumferentially spaced apart relation to each other, radial torque drive pins operatively disposed correspondingly in such sets of spline portions and interengagingly interconnecting the housing and mandrel for common rotation about such longitudinal axis and for selectively limited relative reciprocal displacement longitudinally with respect to each other along such axis, the mandrel exterior and housing bore having cooperating confinement wall portions including opposed axially extending and radially confining cylindrical side walls and opposed radially extending and axially confining annular end walls together defining an annular shock absorber work chamber therewithin of longitudinally varying and radially constant selective maximum and minimum longitudinal dimension and corresponding volume in dependence upon the selectively limited reciprocal displacement of the mandrel and housing with respect to each other and in turn the corresponding relative longitudinal displacement of such annular end walls toward and away from each other, and temporarily internally compressible and resilient shock absorbing silicone rubber material of self-sustaining selective three dimensional perimetric annular shape having a normal volume confined within and operatively occupying essentially completely the longitudinal extent of the interior of the work chamber at maximum longitudinal dimension and maximum volume and operatively arranged therein in constant radial inter-supportive abutting surface contact with the common longitudinal extent of both of such cylindrical side walls and in constant longitudinal operative abutting contact with the continuous extent of both of such annular end walls so as to be placed under dynamic longitudinal stress corresponding to vibratory drill bit displacement shock upon such relative reciprocal displacement of the mandrel and housing and being capable of supportively absorbing strain in internal direction and within the confines of its three-dimensional perimetric shape to reduce its normal volume and concordantly increase its density without expansion or deformation in external direction and within the confines of its three-dimensional perimetric shape when placed under pressure and of returning to its original volume when such pressure is released.

34. Device according to claim 33 wherein the silicone rubber material is maintained in the work chamber in a confined bath of a silicone oil having a substantially equivalent volume reduction thereto under dynamic stress for attendant heat conduction, lubrication and filling of any void spaces within the confines of the work chamber, wherein indirect pressure flow-communicating means are provided for operatively balancing the shock absorbing means with an ambient source of extraneous reference pressure, including an annular floater seal chamber defined between further cooperating axial portions of the mandrel exterior and housing bore and containing a bilateral annular floater seal operatively disposed between such further axial portions, confined silicone oil filled flow path indirectly pressure flow-communicating one side of the floater seal with the work chamber, the silicone oil in such flow path correspondingly having a substantially equivalent volume reduction to that of the shock absorbing means under dynamic stress, and an externally open flow path directly pressure flow-communicating the other side of the floater seal with such ambient source of extraneous reference pressure at the exterior of the device, and wherein the upper end portions of the mandrel and housing are disposed in substantially liquid tight relation with respect to each other and the mandrel abutment end face provides a piston working face peripherally bounded by the confining housing bore thereat which constitutes a cooperating cylinder therefor to effect relative outward displacement of the mandrel from such housing under a driving force corresponding to the flow of drilling fluid supply through the mandrel bore and acting against such piston working face in a direction from such upper end to such lower end for counteracting opposing forces acting in the opposite direction including such ambient source of extraneous reference pressure.

* * * * *